United States Patent [19]

Neugart et al.

[11] Patent Number: 4,722,102

[45] Date of Patent: Feb. 2, 1988

[54] BATH FIXTURE

[75] Inventors: Dietmar Neugart, Lauterbach; Werner Heinzelmann, Alpirsbach, both of Fed. Rep. of Germany

[73] Assignee: Hans Grohe GmbH & Co. KG, Fed. Rep. of Germany

[21] Appl. No.: 839,129

[22] Filed: Mar. 12, 1986

[30] Foreign Application Priority Data

Mar. 15, 1985 [DE] Fed. Rep. of Germany ..... 3509311

[51] Int. Cl.[4] ..... E03C 1/04

[52] U.S. Cl. ..... 4/192

[58] Field of Search ..... 4/192, 193, 194, 195, 4/196, 191, 208

[56] References Cited

U.S. PATENT DOCUMENTS 1,658,159 2/1928 Ernst et al. ..... 4/195
2,091,553 8/1937 Mallet ..... 4/195

FOREIGN PATENT DOCUMENTS 1290498 3/1969 Fed. Rep. of Germany ..... 4/192
2219325 10/1973 Fed. Rep. of Germany ..... 4/192
2653754 6/1978 Fed. Rep. of Germany .

*Primary Examiner*—James E. Bryant, III
*Assistant Examiner*—L. J. Peters
*Attorney, Agent, or Firm*—Steele, Gould & Fried

[57] ABSTRACT

A bath fixture for fixing in a bath overflow hole is provided on the outside of the bath with an overflow casing and on the inside of the bath with a casing braceable therewith for receiving a mixer valve, the pipes leading to the mixer valve and a water outlet. The casing can be braced against the bath from the inside thereof. The water outlet is positioned in spaced manner above the bath rim. All control elements are also positioned above the bath rim.

18 Claims, 7 Drawing Figures

BATH FIXTURE

BACKGROUND OF THE INVENTION

The present invention relates to a bath fixture to be mounted in a bath tub overflow hole and through which is passed the supply pipe for hot and optionally cold water, together with a transfer member for operating the bath drain valve. The device has a fixture body arranged on the inside of the bath and the body is braceable with respect thereto having a water outlet, a water overflow duct and an operating member for the bath drain.

In a known bath fixture or battery of this type (German Auslegeschrift 26 53 754), the fixture body is constructed as a one-piece block in which the hot and cold water pipes are defined by ducts or bores, which run to a mixer valve, which forms part of the block. The bath outflow takes place at the bottom shaped-in of the fixture body and once again a shaped-in duct shaped into the casing block leads to the outlet. A conversion member for a shower hose is arranged in the vicinity of the bath overflow opening. The fixture body is braced from the outside of the bath by means of a bracing member. As a result of this one-piece, solid construction, this known fixture has a complicated structure and can only be installed and maintained with difficulty. Disassembly is not possible once the bath has been installed. When the bath tub is completely full, the outlet is positioned below the water surface, which also applies to the shower conversion member.

A bath unit is also known (German Pat. No. 22 19 325) in which the mixer valve extends from the outside of the bath tub into the latter through the bath overflow hole. As bath overflow holes have standard cross-sections, it is necessary to use a special, very narrow mixer valve, which also further decreases the cross-section of the standard overflow hole.

SUMMARY OF THE INVENTION

The problem of the invention is to provide a bath battery for fixing in a bath overflow hole, which has a simple, material-saving and space-saving construction, which can easily be installed and maintained and which leads to advantages in hygiene.

According to the invention this problem is solved in that the battery body is constructed as a casing for mounting the valve housing, bath outlet and for receiving at least one hot water pipe running from the overflow hole via the valve to the bath outlet and that the latter is located above the rim of the bath.

Through the subdivision of the bath-side part of the bath fixture into a casing and pipes and outlet separate therefrom, it is possible to give the fixture casing a relatively simple construction, e.g. it is made from thinner material or plastic, whereas the other functional parts can also be made from other materials, e.g. metal. The pipes can run from the overflow hole to the water outlet, which facilitates insulation and also replaceability. The bath outlet, for which conventional components can be used, is advantageously positioned spaced above the rim, which ensures that if an under pressure or vacuum occurs in the water pipe, no dirty water is sucked back.

According to a further development of the invention, the casing is constructed for mounting a mixer valve connected to a cold water pipe leading through the overflow hole and the hot water pipe. It is particularly advantageous that the mixer valve can be fixed as a separate component in the casing of the fixture body. It is connected by pipes both to the water connection and to the water outlet.

It is advantageously possible for at least one pipe to be shaped into the casing of the fixture body, e.g. by casting or injection moulding. It is also possible to insert the pipes as thin tubes in a mould and to cast, injection mould or foam the casing round the tubes.

However, it is particularly advantageous if at least one pipe can be fitted as a separate component in the casing. It is then possible to subsequently install the pipes if this is desired. In addition, it is then possible to replace the pipes and functional parts without the casing.

According to the invention, the casing has a cover, which seals of its interior. For example the cover can be of the hang-in type, securable by a single screw, which is arranged in hidden manner under the actuating member for the bath drain valve.

Whereas in the prior art the mixer valve is arranged directly in the vicinity of the overflow opening of the bath, the invention proposes arranging the mixer valve in displaced manner with respect to the overflow hole, particular preference being given to an upwards displacement. This makes it easier to place the actuating members of the mixer valve and optionally a conversion means above the bath rim or water level. It also reduces the amount of space required. It is also easier to keep these components clean, because they are located above the dirty water level.

According to the invention the casing has a connection for a shower hose leading to a shower, as well as a conversion means for the shower which is preferably positioned above the bath rim. The shower hose can be located within the bath.

Although it is advantageous to position the control elements for the valve, particularly the mixer valve above the bath rim, this is not absolutely necessary. For example the control elements can also be positioned in the area below the bath tub rim.

According to the invention, the bath outlet is pivotably mounted about an axis preferably running at right angles to the water outflow direction.

The water outer can e.g. be positioned laterally on the casing. It is then advantageously possible to arrange the connection for the shower hose on the side of the casing opposite to the bath outlet. It is also possible to place the bath outlet at the front, with the shower outlet on one side and the conversion means on the opposite side of the casing.

It is also possible to place the bath outlet in the vicinity of the top of the casing, whereby the bath outlet can both be directed vertically downwards and towards the side and it is even possible to have an outflow direction in which the water is initially directed slightly upwards. It is also possible according to the invention to pass the shower outlet out of the bath via the overflow hole.

For simply fixing the casing, it can be braced with an overflow casing arranged on the outside of the bath and specifically from the inside of the bath. This makes it possible not only to relatively easily install the casing, but it can even be replaced after the bath has been installed.

According to the invention, the overflow casing has an externally threaded, cylindrical shoulder extending through the overflow hole and through which pass the supply pipes, transfer member and overflow. Prior to the installation of the bath, the overflow casing with the supply pipes is installed, so that the fitting of the fixture casing form from the inside of the bath is then particularly easy. The casing on the shoulder can be pressed by a nut against the bath tub. Advantageously a seal is placed between the overflow casing and the bath rim.

The pipes can advantageously be fitted in that on the shoulder is fixed a plate having the end of the at least one pipe and it can in particular be screwed down. This also makes it possible to subsequently replace pipes.

BRIEF DESCRIPTION OF THE DRAWINGS

The invention is described in greater detail herein after relative to a non-limitative embodiment and the attached drawings, wherein show.

DETAILED DESCRIPTION OF THE PREFERRED EMBODIMENT

Figure 1:
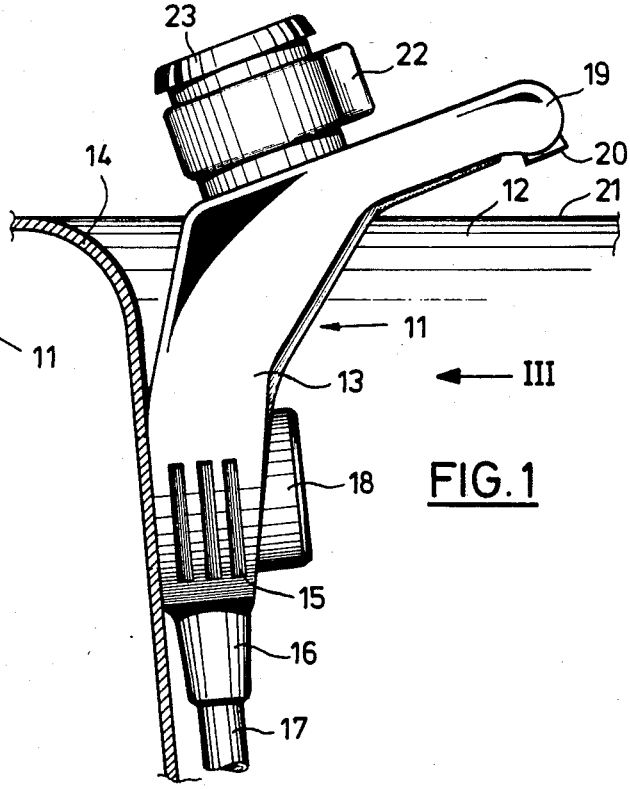
FIG. 1, a simplified side view of a bath fixture constructed according to the invention.

The bath fixture 11 shown in FIG. 1 is fixed in the overflow hole of a diagrammatically represented bath 12. The bath fixture contains a casing 13, which is fixed to the sidewall 14 of bath 12. A plurality of overflow openings 15 are arranged laterally on casing 13. A connection 16 for a shower hose 17 is arranged on the bottom of casing 13. Shower hose 17 leads downwards and is entirely located within bath 12. on the front remote from sidewall 14 casing 13 contains a knob 18 as an operating member for the drain valve.

Casing 13, which has a roughly arcuate configuration, is provided at its upper end 19 remote from sidewall 14 with a bath outlet 20, which is only generally shown. Said bath outlet 20 is located above the upper edge or rim 21 of bath 12 and is advantageously spaced by approximately 20 mm therefrom.

Within the casing 13 of bath fixture 11 is also mounted a mixer valve, which has a control element 22 for setting the temperature and/or quantity of water flowing out of bath outlet 20, together with a conversion means 23 functioning as a diverter valve. The conversion means 23 makes it possible to select whether or not water flows out of bath outlet 20 or through the shower hose 17 to a hand-held shower head (not shown).

Figure 2:
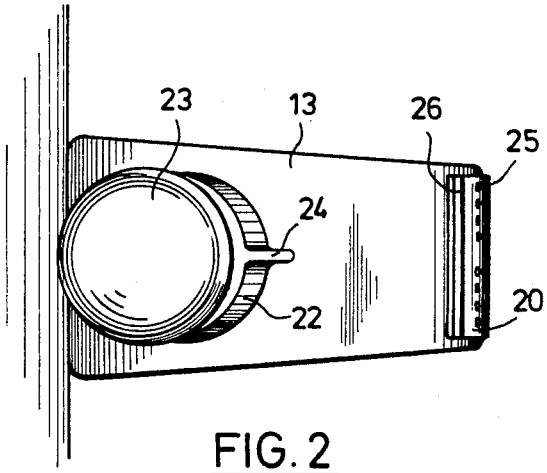
FIG. 2, a plan view of the arrangement according to FIG. 1.

The bath fixture casing 13 has a slight wedge shape in plane view, cf FIG. 2. Conversion means 23 can be operated by pressing, while control element 22 has a projecting flap 24 to facilitate the operation thereof. The bath outlet 20 has a roughly roller-shaped construction, the water flowing out through openings 25 in its cylindrical surface. Outlet 20 can be rotated about its longitudinal axis with the aid of a rib 26, so that the direction of the outflowing water can be modified.

Figure 3:
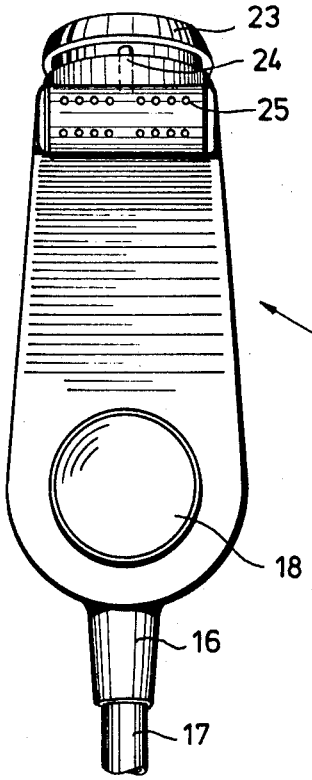
FIG. 3, a front view of the fixture in the direction of arrow III in FIG. 1.

FIG. 3 is a front view of bath fixture 11, where there is a slight wedge shape, which is rounded in semicircular manner on the bottom. The circular knob 18 is roughly level with the overflow hole (not shown) of bath 12.

Figure 4:
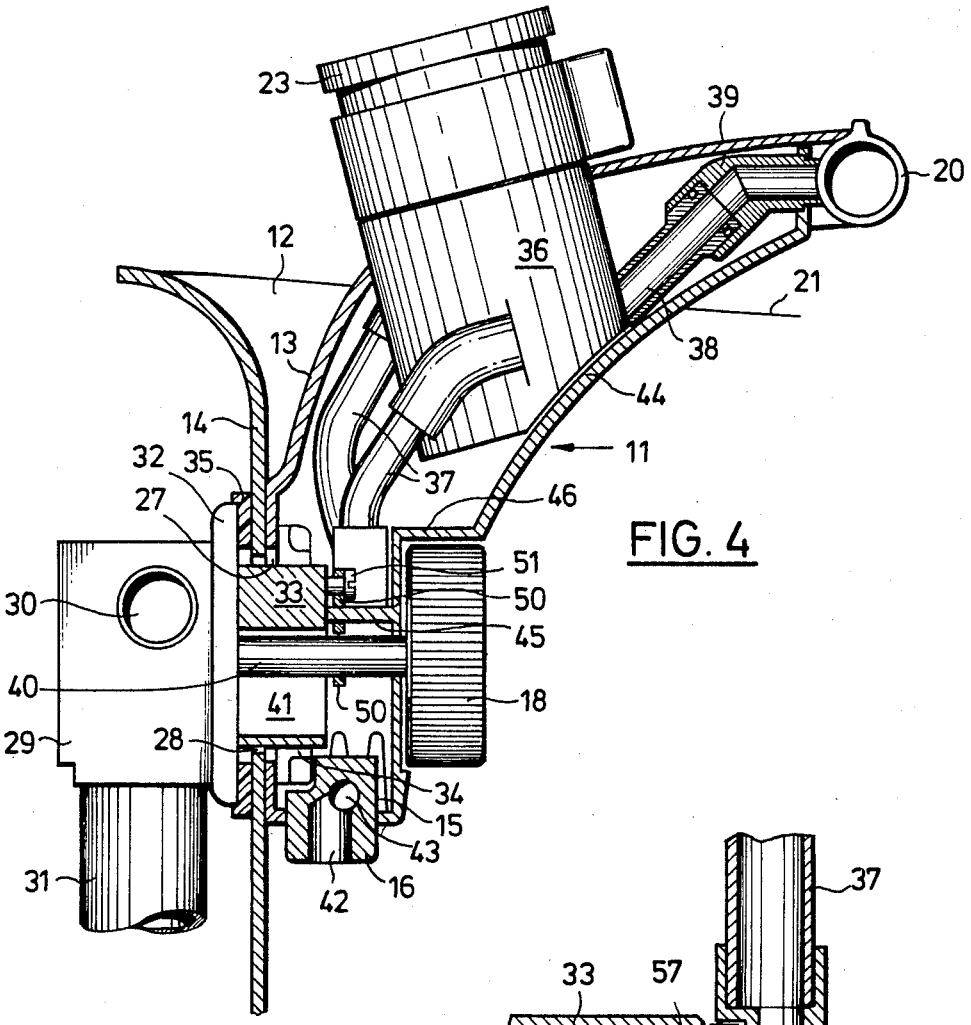
FIG. 4, a longitudinal section through a bath fixture.

FIG. 4 is a section roughly in the same arrangement as in FIG. 1 through a bath fixture according to the invention. Casing 13 of bath fixture 11 has a hole 27, which is arranged roughly level with the overflow hole 28 of bath 12. An overflow casing 29 is arranged behind sidewall 14 on the outside of bath 12 and into said casing issue a diagrammatically represented supply pipe 30 for cold water and a similar hot water supply pipe on the opposite side. On the bottom of overflow casing 29 is provided the actual overflow 31, through which the overflowing water flows out of the bath. Overflow casing 29 has a flange-like plate 32 and connected thereto a circular cylindrical shoulder 33 with, on its outside, an external thread. Shoulder 33 engaged through the overflow hole 28 of bath 12 and through the fixing hole 27 of the rear wall of casing 13 of the bath fixture 11. A nut 34 is screwed onto its external thread. Between the outside of sidewall 14 of bath 12 and the flange-like plate 32 is placed a seal 35. By tightening nut 34, casing 13 is braced against the overflow casing 29, while interposing seal 35 and the sidewall 14 of bath 12, bracing taking place from the inside of the bath.

In its interior, casing 13 secures a mixer valve casing 36, which is not shown in detail, which projects outwards on the top of casing of casing 13, so that the control elements are accessible from the outside.

Two pipes 37 extend to the mixer valve casing 36 from the cylindrical shoulder 33 of overflow casing 29. The pipes 37 are components separate from casing 13 and are fixed to the cylindrical shoulder 33 in a manner to be described hereinafter. A further pipe 38, inserted in sealed manner in an issuing member 39, extends from mixer valve 36 to outlet 20.

A rod 40 connected to knob 18 extends through the shoulder 33 of overflow casing 29 and converts the rotary movement of knob 18 into an opening and closing movement of the drain valve. For this purpose, it is possible to provide e.g. a Bowden wire on the overflow casing 29.

Below rod 40, shoulder 33 has a passage 41, which is connected to the interior of casing 13, which is provided in its lower area with the overflow openings 15 mentioned in connection with FIG. 1. Thus, the water can flow out of the bath through overflow openings 15 and passage 41 of the cylindrical shoulder 33.

Connection 16 for the shower hose 17 arranged on the bottom of casing 13 contains a blind bore 42, passing from the bottom and which passes into a transversely directed bore 43. A not shown pipe leading to the mixer valve 36 is inserted in cross-bore 43 and the water can be passed into it with the aid of conversion means or diverter 23.

The hot and cold water supply pipes which, within casing 13, pass into pipes 37 are also passed through shoulder 33 and namely through the upper half thereof.

On its side directed into the interior of bath 12, casing 13 can be closed by a cover 44, which an be engaged in casing 13 and in the vicinity of overflow hole 28 can be screwed by a screw 45 to cylindrical shoulder 33. Screw 45 is positioned in such a way that it is covered by knob 18, so that it is not possible to see the fixing of cover 44. in the vicinity of knob 18, cover 44 has a recess 46, so that the side of casing 13 directed into the interior of bath 12 is as smooth as possible.

Figure 5:
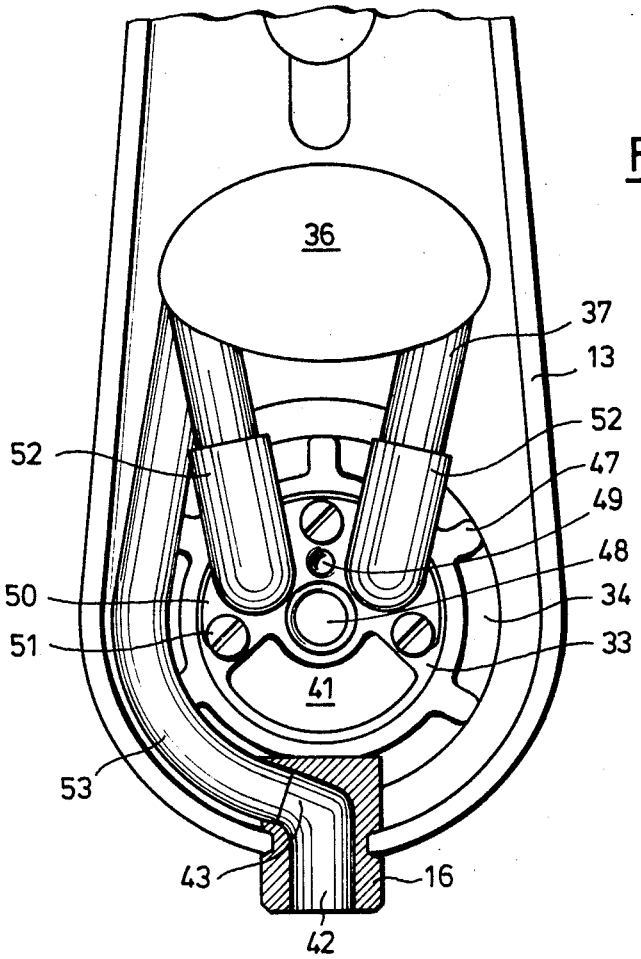
FIG. 5, a broken away front view with the casing cover removed.

FIG. 5 shows on a larger scale a plan view of the inside of casing 13 with cover 44 removed. A nut 34 is screwed onto the cylindrical shoulder 33 and is provided with several circumferentially distributed ribs 47 to facilitate operation. Cylindrical shoulder 33 is centrally provided with a cylindrical passage 48 for the passage of rod 40 of knob 48. The tapped hole 49 for inserting screw 45 is positioned directly above passage 48. A plate 50 is screwed with the aid of three screws 51 to shoulder 33 and two pipe elbows are fixed thereto. From pipe elbows 52, the pipes 37 pass to a diagrammatically represented mixer valve casing 36. Plate 50 with pipe elbows 52 can be fixed to shoulder 33 following the tightening of nut 34 as a result of its dimensions. Correspondingly it can also be removed again if necessary to without it being necessary unscrew casing 13 from the bath. Below plate 50 can be seen the already mentioned passage 41, which forms an overflow duct.

The lower end of a further pipe 53 is inserted in crossbore 43 of connection 16 for shower hose 17 and can be supplied with water by conversion means or diverter 22. Pipe 53 leads laterally past the shoulder 33.

Figure 6:
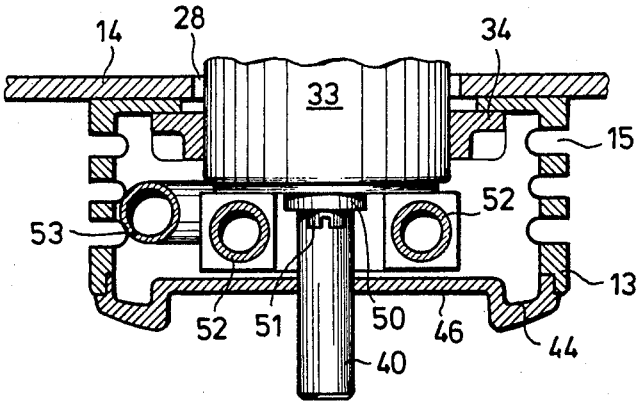
FIG. 6, a horizontal section through the bath fixture.

FIG. 6 shows a horizontal section and the cylindrical shoulder 33 of drain casing 29 is only diagrammatically represented. Plate 50 is screwed thereto with the aid of screws 51, to which are fitted the two pipe elbows 52. The two pipes lead past the center on either side thereof and through which is passed the rod 40. The further pipe 53 for the shower hose can be seen to the far left.

On both side walls casing 13 has in each case three slot-like overflow openings 15. The water can pass through said overflow openings 15 into the interior of casing 13 and from there through passage 41 and overflow casing 29 to the outflow means. Cover 44 engages between the edge of casing 13 and contains the aforementioned recess 46 in the vicinity of rod 40.

Figure 7:
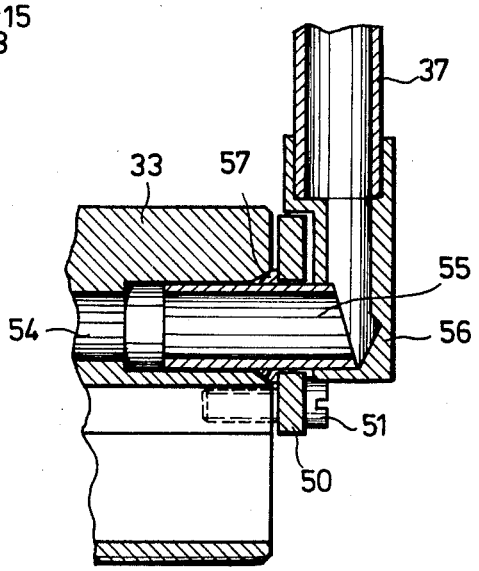
FIG. 7, a detail of fixing a pipe in the case the bath fixture according to the invention.

The fitting of the pipes to plate 50 is shown again on larger scale in FIG. 7. The cylindrical shoulder 33 of overflow casing 29 contains for each pipe to be passed through a bore 54, which has an increased diameter from the inside of the bath. A short bushing or sleeve 55 is passed through plate 50 via a corresponding bore which, on its side directed into the interior of the bath is fixed in an angle tube 56, which can take place by soldering, welding or bonding. Pipe 37 is fixed to the other end of the angle tube 56, which can also take place by welding, soldering or bonding.

A cross-sectionally, approximately wedge-shaped seal 57 is placed round the bushing 55 on the side of plate 50 remote from the angle tube 56. The end of bore 54 directed into the interior of bath 12 is chamfered. If plate 50 is now pressed with the aid of screws 51 against shoulder 33, then the deformation of seal 57 leads to a pressing thereof against the bushing 55, so that as a result of this relatively simple measure a firm watertight connection of bushing 55 to shoulder 33 is obtained, but said connection can be detached again at any time.

The invention provides a bath fixture having a casing arranged on the inside of the bath and which can be braced therewith from the inside. The casings used for receiving pipes to the mixer valve and from the latter to the water outlet, as well as for mounting the mixer valve. The mixer valve is spatially separated from the overflow hole and the drain valve controls. The casing can be constructed in a relatively simple, lightweight and therefore material-saving manner. It only has a supporting function, while the function of carrying water and mixing is taken over by other components. The casing can also be completely made from cast metal with ducts forming the pipes arranged therein.

What is claimed is:

1. A bath fixture to be mounted in an overflow hole of a bath tub, comprising:

at least one of a hot water and cold water supply pipe positioned to extend through the overflow hole;

a transfer member extending through the overflow hole for operating a bath drain valve;

a fixture body arranged on an inside of the bath tub, the fixture body being engageable against the tub, the fixture body being constructed as a casing for mounting a control for a bath water outlet and for receiving at least one of a hot water pipe and a cold water pipe leading from the overflow hole to the bath outlet and having a bath overflow duct and an operating member for the bath drain valve, the bath outlet being positioned above a rim of the bath tub;

a mixer valve connected with the hot water and cold water supply pipes through a hot water pipe and a cold water pipe leading through the overflow hole, the mixer valve being mounted in the casing and the mixer valve being displaced upwardly from the overflow hole and in-line with the bath outlet.

2. A fixture according to claim 1, wherein the bath outlet is pivotable about an axis approximately at right angles to a water outflow direction.

3. A battery according to claim 1, wherein at least one pipe is shaped into the casing.

4. A battery according to claim 1, wherein at least one pipe can be fitted in the casing.

5. A battery according to claim 1, wherein the casing has a cover.

6. A fixture according to claim 1, wherein the bath outlet is elongated along an axis approximately at right angles to a water outflow direction.

7. A fixture according to claim 1, further comprising means on the casing engaging with the bath tub at the overflow hole and defining a turning prevention means preventing relative rotation of the fixture and the bath tub.

8. A fixture according to claim 1, wherein a control element for the mixer valve is positioned above the bath tub rim.

9. A fixture according to claim 1, further comprising a connection for a shower hose on the casing, leading to a shower fitting, and a shower diverter valve operable to divert flow to the shower fitting.

10. A fixture according to claim 9, further comprising means for leading a shower outlet out of the bath tub through the overflow hole.

11. A fixture according to claim 9, wherein the connection for the shower hose is arranged on a side of the casing opposite to the bath outlet.

12. A fixture according to claim 9, wherein shower diverter valve is disposed above the bath tub rim.

13. A fixture according to claim 1, further comprising means for bracing the fixture against the bath tub, the casing being engageable on an inside of the bath tub and an overflow casing being engageable on an outside of the bath tub.

14. A fixture according to claim 13, wherein the overflow casing has a threaded, cylindrical should extending through the overflow hole and through which pass the water supply pipes, the transfer member and the overflow to the overflow casing.

15. A fixture according to claim 14, wherein the overflow casing is braced against the bath tub by a nut urging the cylindrical shoulder against the bath tub.

16. A fixture according to claim 15, wherein the plate is screwed to the cylindrical shoulder.

17. A fixture according to claim 14, further comprising a plate having an opening for at least one pipe, the plate being fixed to the cylindrical shoulder.

18. A fixture according to claim 1, wherein the bath outlet is positioned in a vicinity of a top of the casing.

* * * * *

UNITED STATES PATENT AND TRADEMARK OFFICE

CERTIFICATE OF CORRECTION

PATENT NO. : 4,722,102

DATED : Feb. 2, 1988

INVENTOR(S) : Dietmar Neugart and Werner Heinzelmann

It is certified that error appears in the above-identified patent and that said Letters Patent is hereby corrected as shown below:

Column 1, line 19, delete "shaped-in".

Column 1, line 20, delete "shaped-in".

Column 2, line 17, delete "of" and insert --off--.

Signed and Sealed this

Eleventh Day of April, 1989

*Attest:*

DONALD J. QUIGG

*Attesting Officer*

*Commissioner of Patents and Trademarks*